US005577803A

United States Patent [19]

Guilbaud

[11] Patent Number: 5,577,803

[45] Date of Patent: Nov. 26, 1996

[54] ADJUSTABLE SEAT

[75] Inventor: Jean-Pierre Guilbaud, Roanne, France

[73] Assignees: Tritube; Jean-Pierre Guilbaud Sarl, both of France

[21] Appl. No.: 498,853

[22] Filed: Jul. 6, 1995

Related U.S. Application Data

[62] Division of Ser. No. 146,701, Nov. 2, 1993, abandoned.

[30] Foreign Application Priority Data

Nov. 4, 1992 [FR] France ..... 92 13508

[51] Int. Cl.[6] ..... A47C 1/022

[52] U.S. Cl. ..... 297/314; 297/338; 297/361.1; 248/396

[58] Field of Search ..... 297/284.6, 313, 297/314, 337–339, 344.19; 248/133, 394, 396, 603, 614; 108/7, 147

[56] References Cited

U.S. PATENT DOCUMENTS

| | | | |
|---|---|---|---|
| 3,558,094 | 1/1971 | Radke | 248/631 |
| 3,902,755 | 9/1975 | Sirol | 297/339 |
| 4,095,770 | 6/1978 | Long | 248/371 |
| 4,957,102 | 9/1990 | Tan et al. | 297/284.6 X |
| 5,137,329 | 8/1992 | Neale | 297/284.6 |

*Primary Examiner*—Peter R. Brown

*Attorney, Agent, or Firm*—Harris Beach & Wilcox, LLP

[57] ABSTRACT

An adjustable seat having a seat cushion and a backrest which are both secured to an underframe. The seat further includes a hydrostatic system of incompressible fluid contained within a closed circuit. The hydrostatic system includes individual actuators which bear against the seat cushion or both the seat cushion and backrest to adjust the inclination thereof. A shutoff member is provided to alternately allow and prevent movement of fluid within the closed circuit to change and then maintain a desired inclination.

3 Claims, 7 Drawing Sheets

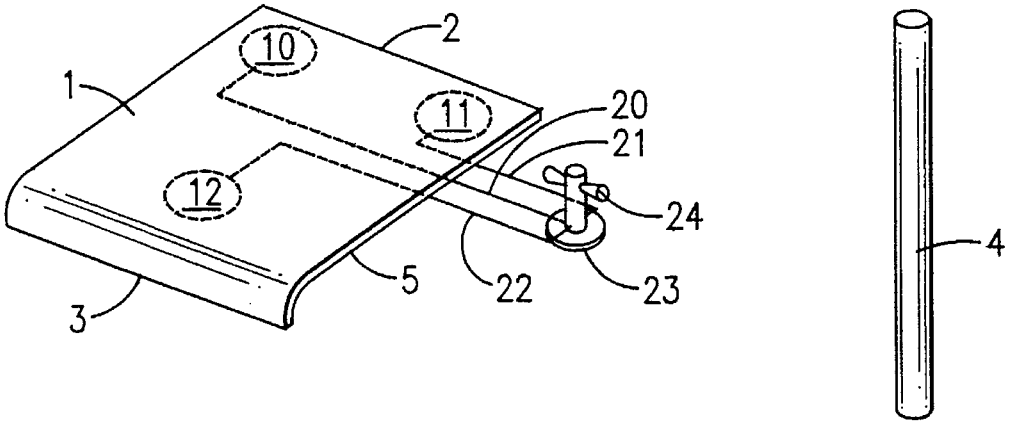
FIG.1
FIG.2
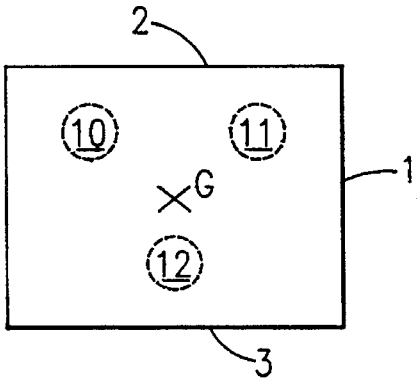
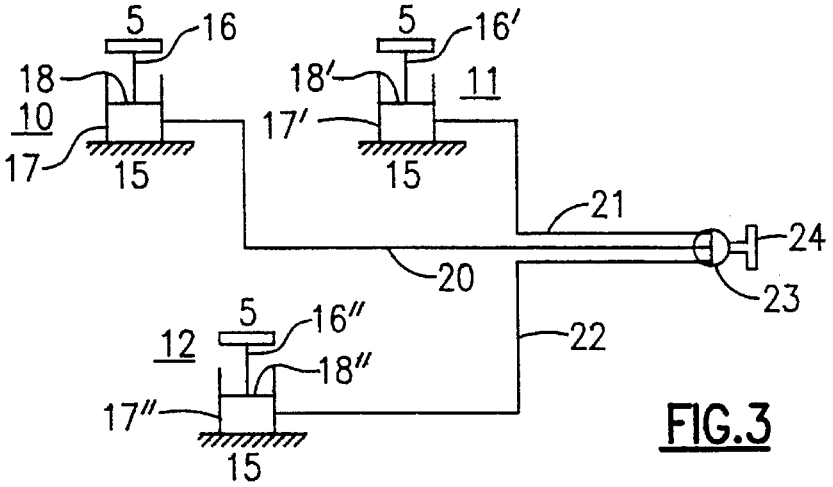
FIG.3

ADJUSTABLE SEAT

This is a divisional of application Ser. No. 08/146,701 filed Nov. 2, 1993, now abandoned.

BACKGROUND OF THE INVENTION

1. Field of the Invention

The invention relates to a novel type of adjustable seat.

2. Discussion of the Background Art

As is known, a seat is essentially formed of a seat cushion and of a backrest, both secured to an underframe. A suitable mechanism makes it possible to adjust the inclination of the seat cushion and/or of the backrest. Adjustable seats have many applications, particularly as seats for offices, workshops, laboratories, for the disabled, for the sick, as well as in vehicles or aircraft.

These seats equipped with backrests generally call upon mechanisms formed of articulations, of springs, and of systems for locking by clamping. Although widely used, this solution has the drawback of requiring numerous components, which leads to a high cost, particularly a high assembly cost, and to a relatively large size. Moreover, it is difficult to build into these seats complementary functions such as adjustment of the damping. Finally, on an ergonomic level, the control of the locking members is generally deemed to be unsatisfactory.

Seats have also been proposed in which the inclination mechanism is controlled by electric motors. This solution, although satisfactory, is very expensive and requires the presence of a source of energy.

Document U.S. Pat. No. 2,615,499 described a chair in which each leg includes a hydrostatic system, which can slide vertically, these various hydrostatic systems being connected up in a closed circuit in pairs, respectively on the right-hand side and on the left-hand side, so as to incline the chair, respectively the seat-cushion and backrest assembly, either forward or backward. Here, the hydrostatic system which forms the actual leg, and replaces the castors or the runners, rests directly on the ground, which allows the whole seat assembly only forward or backward inclination movements, in the manner of a rocking chair.

The invention overcomes these drawbacks. It envisages a novel type of inclinable seat, which is reliable and comfortable in all positions, in which the mechanism is simple, effective, small, easy to actuate by the user and which remains of attractive cost.

This adjustable seat, formed of a seat cushion and of a backrest which are secured to an underframe and which comprises a hydrostatic mechanism for adjusting the inclination of the seat cushion and/or of the backrest, is one wherein the hydrostatic inclination mechanism bears respectively on a base arranged on the top of the underframe and on the underside of the seat cushion (or of the backrest).

In other words, the invention consists in using the hydrostatic transmission, which is moreover well known, and has been for a long time, to incline the seat cushion or the backrest, and no longer the legs themselves as is described in document U.S. Pat. No. 2,615,499 mentioned in the preamble.

As is known, a hydrostatic system is a system formed by a plurality of actuating devices connected together by pipelines filled with a fluid in equilibrium, in the manner of communicating vessels. In that way, if one of the actuating devices is lowered, the others rise in proportion through the transfer of fluid contained in the circuit. Preferably, moreover, this fluid is an incompressible fluid, such as oil or water.

In general, the actuating device is of the single-acting hydraulic actuator or flexible actuator type, in which the chamber containing the hydraulic fluid is connected to a base which is fixed onto the underframe. A hydraulic circuit of incompressible fluid connects the various chambers together. In that way, when one of the chambers lowers on one side, the chambers of the associated actuators automatically rise correspondingly, through the transfer of liquid in this circuit.

In a first advantageous embodiment, the hydrostatic system is formed of three single-acting actuators forming a triangle the base of which is arranged on the side of the rear of the seat cushion (or of the backrest), the vertical axis passing through the center of the gravity of the seat and of its load being arranged inside this triangle to ensure good equilibrium of the seat.

In another embodiment, the hydrostatic system includes six single-acting flexible actuators, arranged on either side of a bearing plate forming a base secured to the top of the underframe, namely respectively:

four actuators arranged in a square, resting under the seat cushion and on the base for the inclination of this seat cushion;

two actuators arranged under the bearing plate forming a base and on the support plate of the backrest for the inclination of this backrest.

These six actuators are connected one by one and in closed circuit to a distribution chamber.

In a preferred embodiment, the chambers of the actuators are connected together by a circuit including a shutoff member actuatable by the user, such as, for example, a tap, a locking screw or a valve, controlled by a lever, or even by any other means to control the, transfer of the liquid from one chamber to another. In an advantageous variant, the circuit may also be equipped with distributors, flow limiters, pressure accumulators or motorized pumps, depending on the additional functions which it is desired to obtain. Generally, all the known functions of hydraulic circuits may be used successfully.

In another embodiment, the seat cushion and the backrest are articulated about a horizontal spindle secured to the underframe, and the hydrostatic system, also secured to the underframe, is formed of a plurality of actuators acting respectively on the underside of the seat cushion and on the backside of the backrest, these various actuators being connected together by a common circuit in which the shutoff member is arranged so that the inclination of the seat cushion and of the backrest are synchronized when the shutoff member is open, and locked when it is closed.

BRIEF DESCRIPTION OF THE DRAWING

The manner in which the invention may be realized and the advantages which stem therefrom will emerge better from the embodiments which follow, based on the appended figures, wherein FIG. 1 is a diagrammatic representation, in summary perspective, of a seat cushion of a seat in accordance with the invention, shown in plan view in FIG. 2.

FIG. 3 is a summary representation of the characteristic hydrostatic system of the invention.

Figure 4:
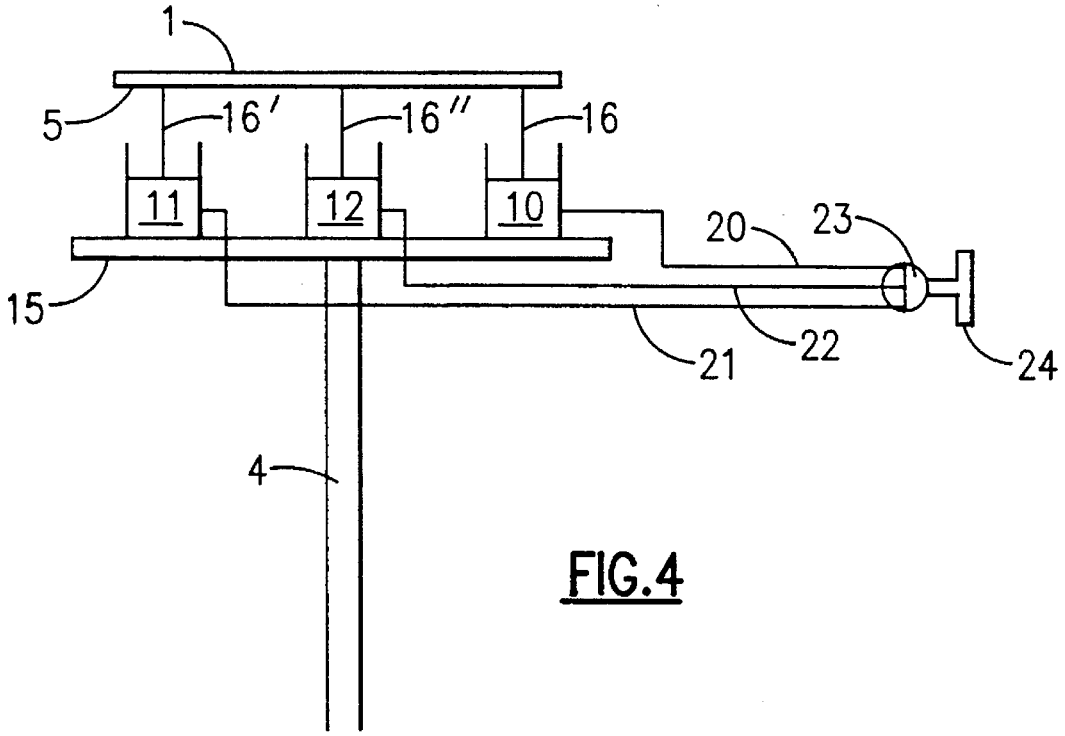
FIGS. 4 and 5 illustrate the operation of the invention.

10, in a flat plan representation of the characteristic hydrostatic system,

11, the hydrostatic system in summary section,

12, the characteristic hydrostatic system in summary perspective,

13 a detailed diagrammatic representation in summary perspective of the device in accordance with the invention.

DETAILED DESCRIPTION OF THE PREFERRED EMBODIMENTS

Referring to FIGS. 1 to 3, the seat comprises, in a symbolized manner, respectively a seat cushion (1) having a rear face (2) and a front face (3), and an underframe (4) to which it is secured by any suitable known means which are not represented. The underside face (5) of the seat cushion (see FIG. 3) comprises three hydrostatic actuators, referenced respectively (10, 11, 12) and arranged in a triangle. Two (10, 11) of these actuators forming the base of the triangle are arranged on the side of the rear face (2), whereas the apex (12) is arranged towards the front (3), so that (see FIG. 2) the vertical axis passing through the center of gravity (G) of the seat and of its load is arranged inside this triangle (10, 11, 12). The seat cushion (1) is secured to the underframe by a suitable mechanism comprising a base symbolized by the reference (15) (FIG. 3).

Each single-acting hydrostatic actuator comprises, in a known manner, a rod (16, 16', 16") secured to the underside (5) of the seat cushion (1), a chamber (17, 17', 17") and a piston (18, 18', 18"). The incompressible hydrostatic liquid, such as water or oil, fills each chamber and these chambers are connected together by pipelines (20, 21, 22) respectively ending in a shutoff member (23) which can be actuated by a suitable member (24). The shutoff member (23) may consist of a tap, a distributor or a valve, actuated by the user by means of the member (24) arranged at the most suitable ergonomic location, such as, for example, the armrest of the seat or one of the lower lateral edges of the seat cushion.

Figure 5:
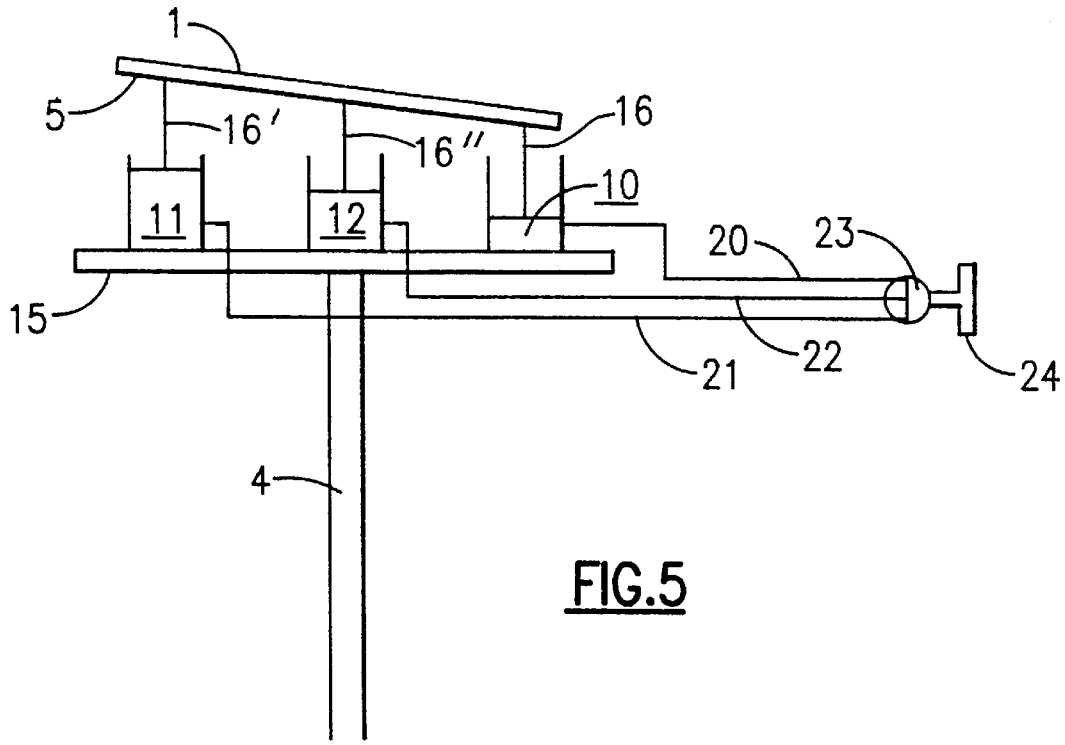

In the equilibrium position (see FIG. 4), all the rods (16, 16', 16") have substantially the same length. When the user wishes to modify his inclination position, he opens the shutoff member (23) by actuating the lever (24), and by leaning his body more on one actuator than on another. In that way, he inclines the seat cushion (1) (see FIG. 5). At this moment, an actuator, for example the actuator (16), is pushed in; but the opposite actuators (16', 16") rise in proportion, so that by the transfer of the fluid in the circuits (20, 21, 22) there is always equilibrium in the circuit. When the user reckons that the seat cushion is in an ideal position, all he has to do is release the shutoff member (23). Thus, the circuit remains in equilibrium and the seat cushion (1) (see FIG. 5) remains immobilized in a position which is inclined in a way which is best adapted to the position sought at a given time.

When the user wishes, for some reason, to modify the inclination of the seat cushion (1) again, all he has to do is to open the shutoff member (23) and, when the new position is reached, to lock it again as before.

Thus, the seat according to the invention is perfectly adapted to the inclination modifications, and this being as a function either of the user's desire, or of his disabilities, or of his need to change position to make a task easier.

Figure 6:
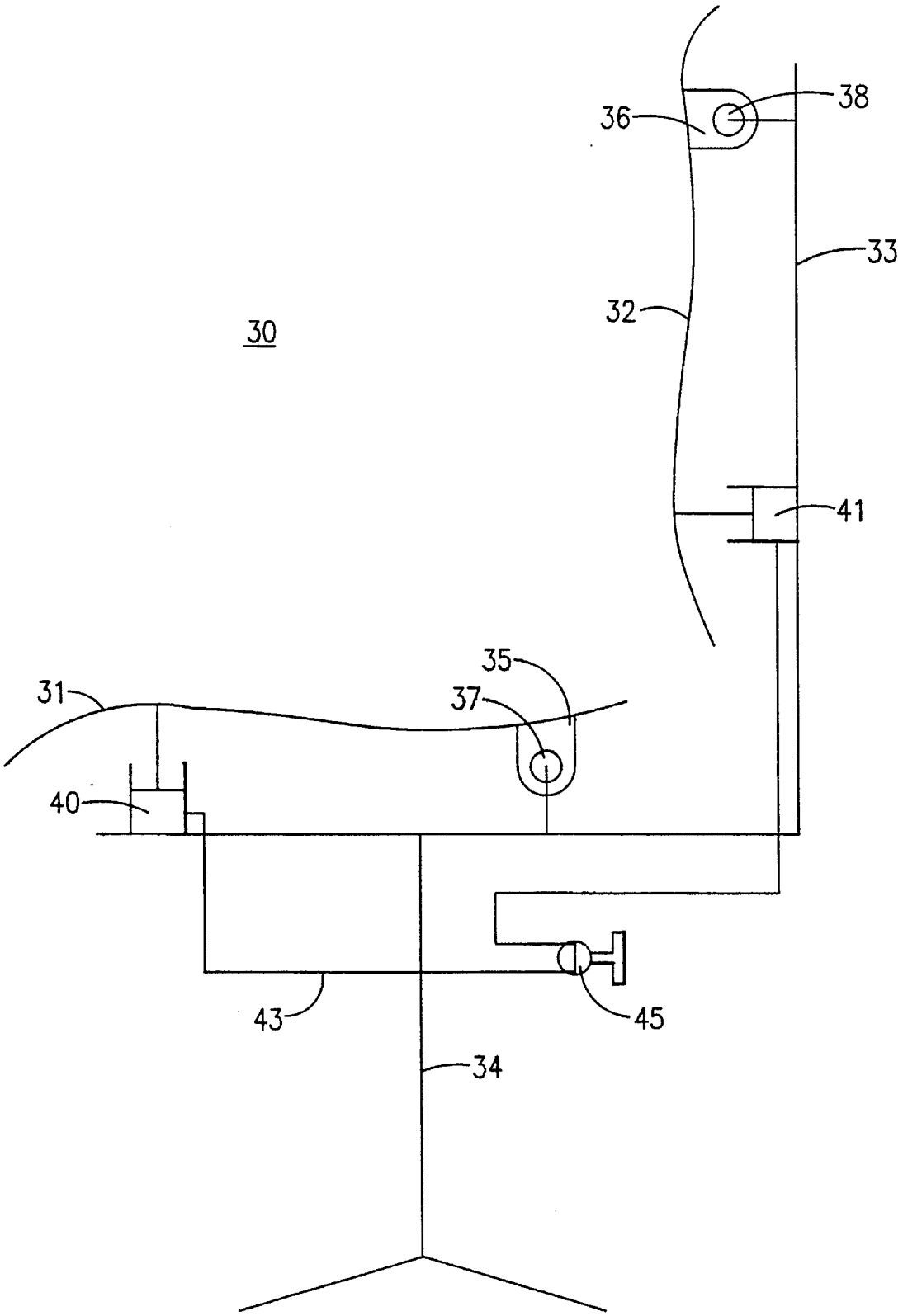
FIG. 6 and 7 are a diagrammatic representation of two embodiments of the invention.

In an embodiment shown in FIG. 6, the seat, denoted by the general reference (30), comprises a seat cushion (31) similar to (1) and a backrest (32), both secured by a chassis (33) to the underframe (34). By virtue of a clevis (35, 36), the seat cushion (31) and the backrest (32) are articulated about two horizontal spindles, respectively (37, 38), secured to the underframe (34). The seat cushion (31) has, on its underside, a first single-acting actuator (40) connected to a similar actuator (41) acting on the back face of the backrest (32). These two actuators (40, 41) are connected together by a circuit (43, 44) in which a shutoff valve (45) actuatable by the user is arranged. Thus, by acting on the valve (45), the fluid is transferred from one branch of the circuit (43) to the other (44). It follows that the inclination of the seat cushion (31) gives rise to a coordinated inclination of the backrest (32). Thus, these two inclinations are synchronized.

Figure 7:
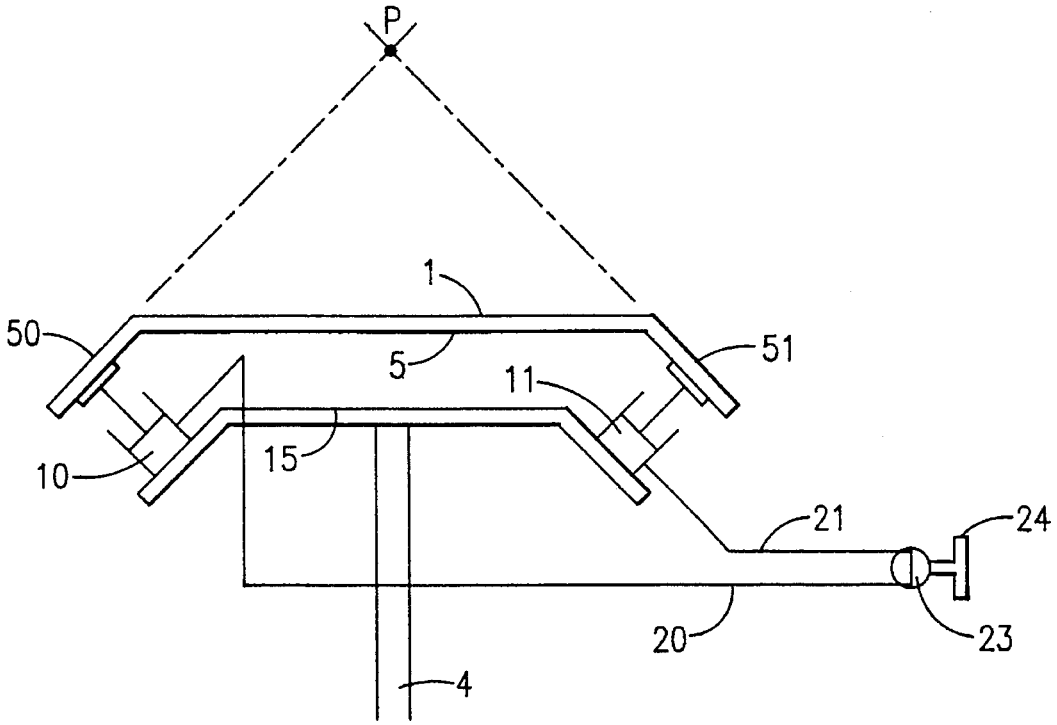

FIG. 7 illustrates another embodiment of the invention, in which, as in FIGS. 1 to 5, the pistons still act on the underside (5) of the seat cushion (1) no longer on a horizontal portion, but perpendicularly on inclined lateral portions (50, 51). The inclination of these lateral portions (50, 51) is such that the meeting point (P) of their extension substantially coincides with the virtual axis of rotation (P) of the seat cushion (1) arranged above this seat cushion, therefore close to the user's center of gravity (G). This arrangement ensures good stability and an increased feeling of comfort for the user.

FIGS. 8 to 13 illustrate, as already stated, a practical embodiment of the invention. This seat, denoted by the general reference (100), is shown with the backrest in a vertical position in FIG. 8 and with the backrest in a backward-inclined position in FIG. 9. This seat (100) comprises an underframe (101), a plate (102) for supporting the backrest (103), which plate is articulated in a clevis (104) about a horizontal spindle (105) secured to the underframe and a seat cushion (106) which rests on a rigid plate (107).

According to one characteristic of the invention, the seat (100) also includes a rigid bearing plate (110) fixed securely to the underframe (101) by means of a suitable framework. This fixed bearing plate (110), which forms the base, is arranged under the seat-cushion plate (107) and above the backrest-support plate (102). On either side of this fixed bearing plate (110) is arranged the characteristic hydrostatic system shown in detail in FIGS. 10 to 12, namely four seat-cushion actuators (115, 116, 117, 118) arranged in a square between the seat-cushion plate (107) and the bearing plate (110), and two backrest actuators (120, 121) arranged at the front and at the rear between the bearing plate (110) and the backrest-support plate (102).

Figure 10:
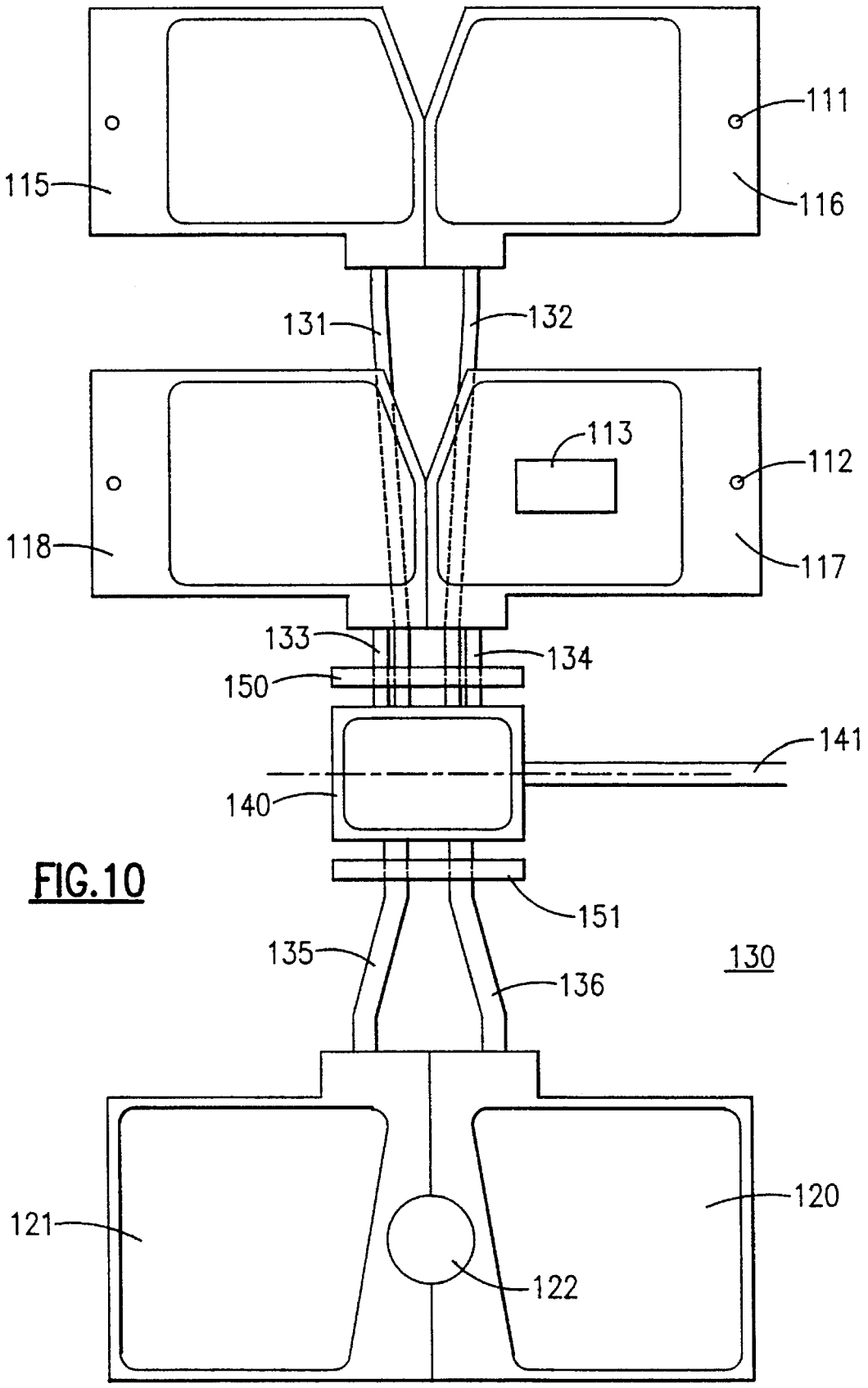
Figure 11:
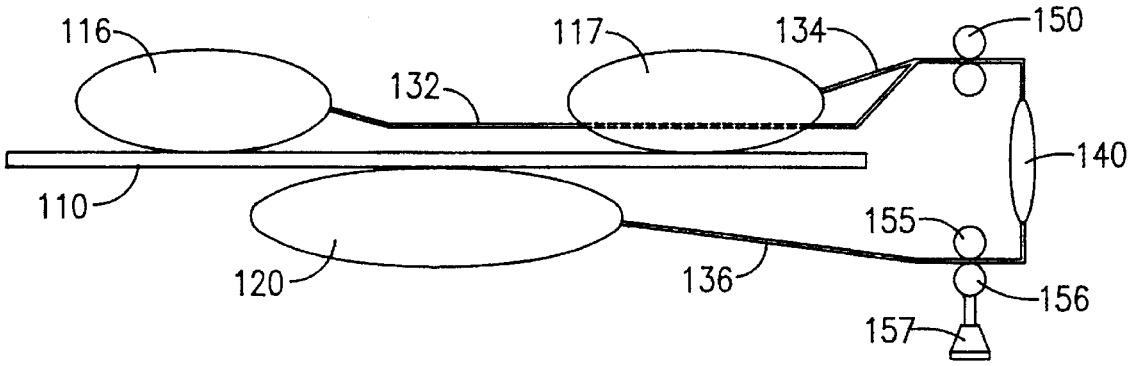

The hydrostatic system (130) detailed in FIG. 10 is formed of a plurality of individual pockets made from a sheet of polyvinyl chloride (PVC), welded on-all four sides, trapping the end of a PVC tube (131 to 136) respectively, which is also welded into the pocket. The other ends of these tubes are connected to a distribution chamber (140), itself coupled to a tube (141) for filling with fluid (water, oil).

The references (111, 112, 122) denote orifices for fixing the actuation-forming chambers onto the compatible plates (102, 107, 110). In a variant, these pockets may be fixed onto these plates by some other system, such as a tape-and-hook assembly (113) known under the registered Trademark "VELCRO".

References (150) and (151) denote a shutoff member respectively for shutting-off the seat-cushion circuit (150)

and the backrest circuit (151). In one embodiment, this shutoff member may consist of a pair of parallel tubes (155, 156) forming a clamp which are brought together (or moved apart) by a closure (or opening) screw (157), depending on the desired inclination movement.

Figure 12:
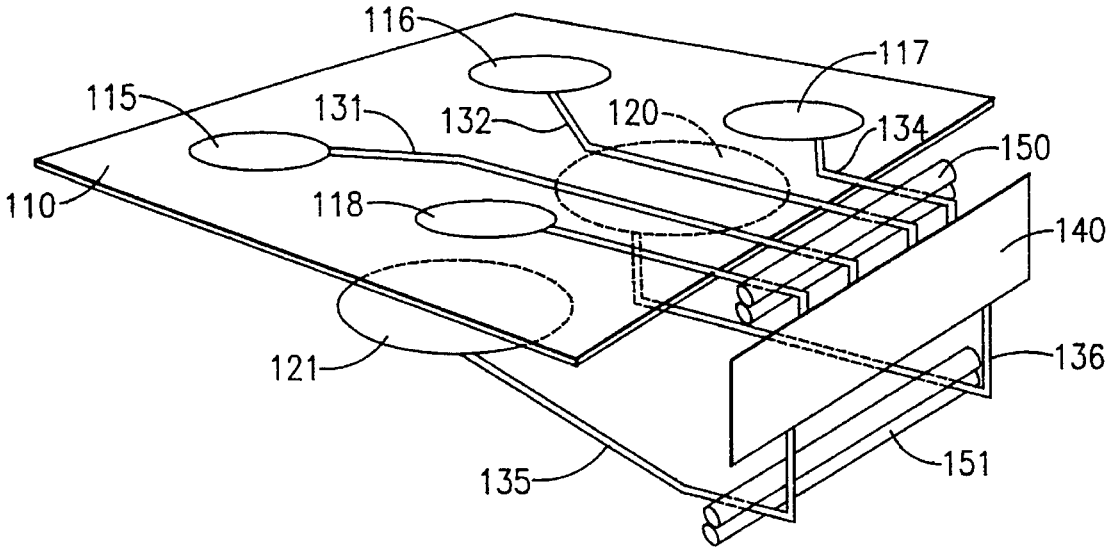
Figure 13:
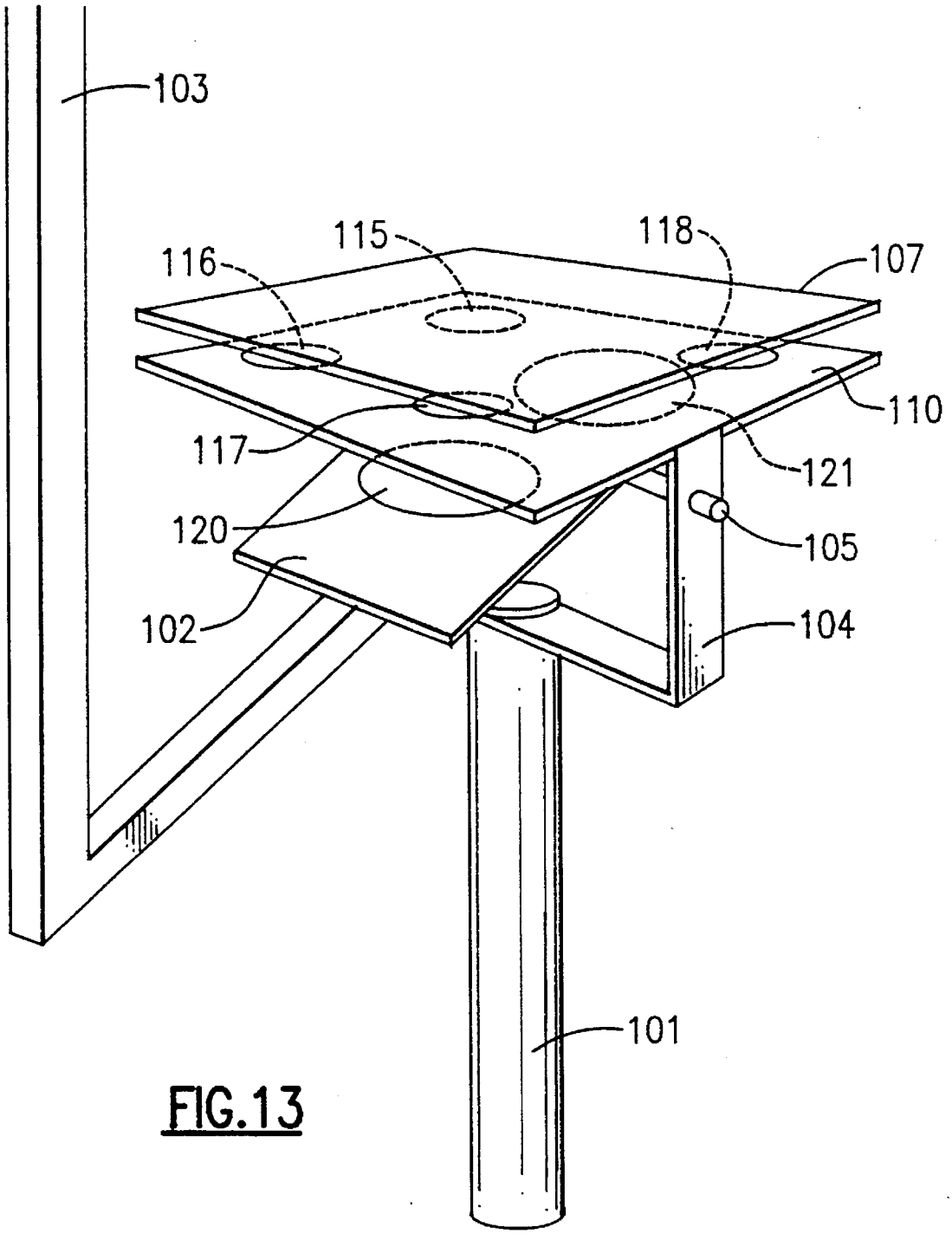

The various actuator-forming pockets (115–118, 120, 121), with their coupling tube (131–136) distribute in (140), are filled with fluid by means of a pipe (141) which is then closed. These various pockets are then positioned on the bearing plate (110) as is shown in FIGS. 12 and 13, namely the seat cushion one (115–118) on the top and the backrest one (120–121) underneath.

Figure 9:
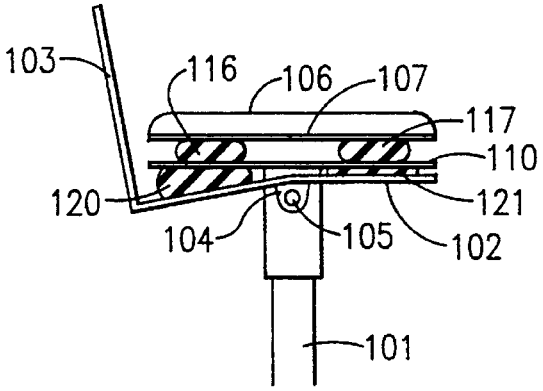

When the user wishes to incline the backrest backward, as is shown in FIG. 9, he opens the corresponding shutoff member (151), for example by unscrewing the screw (157), thereby moving the two parallel rods (155, 156) apart. By pressing, by means of his back, on the backrest (103) the user automatically transfers the fluid (oil or water) from the front pocket (121) to the rear pocket (120).

Figure 8:
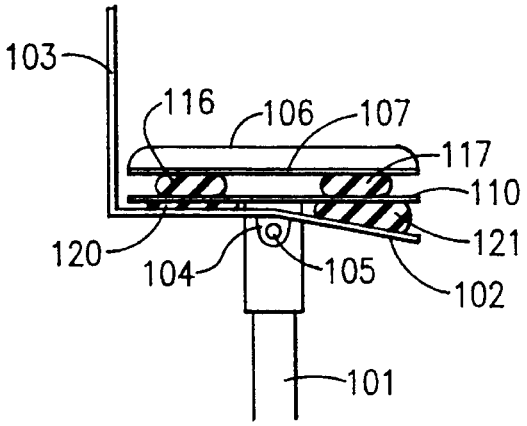
FIGS. 8 to 13 illustrate a practical embodiment of a seat in accordance with the invention, shown in a side view in FIGS. 8 and 9 and in detail, respectively, in Figures.

Once he has found the correct inclination for the backrest (103) he closes the corresponding clamp (151) again. To tilt the backrest forward, for example to return it to the normal position as shown in FIG. 8, the process is reversed. The forward return of the backrest is facilitated in a conventional manner by a return spring, as in existing mechanisms.

Modifying the seat cushion is obtained in the same way, but by actuating the corresponding shutoff member (150).

In another practical embodiment, the two shutoff members (150, 151) can be synchronized, for example by means of a suitable hydraulic circuit.

Thus, depending on the various configurations of the shutoff system, very varied behaviour can be obtained.

When it is desired to move the seat cushion sideways without intervention, that is to say without closing the circuit, which cannot be achieved with current devices, part of the body weight is transferred to the side toward which it is desired to lean. By virtue of the equal pressure, distribution takes place automatically, which considerably improves comfort.

Since the fluid is incompressible, the movements are controlled adjustably and are damped out, which attenuates the consequences of abrupt movements.

Likewise, when the height of the seat cushion (106) is varied with respect to the underframe (101), the front-rear inclination of this seat cushion (106) is automatically compensated for.

Since a better distribution of the loads over the seat cushion is thus obtained, the weight of the occupant's legs is taken up better, which correspondingly relieves the spinal column and eases the blood circulation.

The device according to the invention makes it possible to change position naturally and easily, and to automatically regain optimum adjustment, which could not be achieved until now.

The device according to the invention has numerous advantages compared with those known to date with an inclination mechanism. There may be mentioned:

reduced size of the components of the mechanism, reliable and accurate mechanism, easy and ergonomic location of the unlocking control, that is to say the shutoff control, lower cost, great flexibility of use as regards the adjustments and damping, which ensures better comfort, an absence of noise during the adjustment movements, the fact that the seat adapts itself, which makes it possible to optimize the adjustments, by virtue of the equal pressure.

In that way, these seats can be used successfully in all the applications of inclinable seats, for professional comfort needs, for the sick, the handicapped, and even in the automobile industry.

While this invention has been described in detail with reference to certain preferred embodiments, it should be appreciated that the present invention is not limited to those precise embodiments. Rather, in view of the present disclosure which describes the best mode for practicing the invention, many modifications and variations would present themselves to those of skill in the art without departing from the scope and spirit of this invention, as defined in the following claims.

What is claimed is:

1. An adjustable seat formed of a seat cushion having an underside rigid plate and of an underframe having a bearing rigid plate arranged on the top of the underframe, comprising at least three actuators arranged between the underside plate of the seat cushion and the bearing plate, said actuators being formed by individual flexible pockets, each of said actuators connected in a hydraulic closed circuit by pipe to a distribution chamber, said hydraulic closed circuit comprising a shut-off member arranged between the distribution chamber and the actuators, said shut-off member adapted for actuation by a user such that the seat can be fixed in selected positions with respect to a horizontal surface, said shut-off member including a pair of parallel tubes forming a clamp, said tubes allowing the fluid to move within the circuit when in an open condition and preventing fluid movement when in a closed condition.

2. An adjustable seat according to claim 1 comprising three actuators forming a triangle being positioned with an actuator adjacent each rear corner of said seat and an actuator positioned along a central longitudinal line of said seat and forward of a center point so that the center of gravity of the seat cushion falls within said triangle.

3. An adjustable seat according to claim 1 comprising four actuators forming a square at each corner of the underside plate.

* * * * *